US006860659B2

(12) United States Patent
Penzo

(10) Patent No.: US 6,860,659 B2
(45) Date of Patent: Mar. 1, 2005

(54) TRACTION DEVICE FOR HEAT-SENSITIVE INK RIBBON

(75) Inventor: Mirko Penzo, Barcelona (ES)

(73) Assignee: ITW Espana, Barcelona (ES)

( * ) Notice: Subject to any disclaimer, the term of this patent is extended or adjusted under 35 U.S.C. 154(b) by 0 days.

(21) Appl. No.: 10/656,123

(22) Filed: Sep. 8, 2003

(65) Prior Publication Data

US 2004/0046859 A1 Mar. 11, 2004

Related U.S. Application Data

(63) Continuation of application No. 09/979,975, filed as application No. PCT/ES01/00120 on Mar. 27, 2001, now Pat. No. 6,629,791.

(30) Foreign Application Priority Data

Mar. 31, 2002 (ES) ..... 200000819

(51) Int. Cl.[7] ..... B41J 33/24

(52) U.S. Cl. ..... 400/234; 400/223; 400/235; 400/279; 347/217

(58) Field of Search ..... 400/235, 235.1, 400/234, 279, 281, 223; 347/217

(56) References Cited

U.S. PATENT DOCUMENTS

| | | | | |
|---|---|---|---|---|
| 4,350,454 A | | 9/1982 | Schoenlein | |
| 5,284,396 A | | 2/1994 | Masumura et al. | |
| 5,533,819 A | | 7/1996 | Watanabe et al. | |
| 5,609,426 A | * | 3/1997 | Ito et al. | 400/279 |
| 5,873,662 A | | 2/1999 | Clevinger | |
| 5,906,444 A | | 5/1999 | Jorgensen | |
| 5,975,777 A | * | 11/1999 | Nelson et al. | 400/223 |
| 5,993,092 A | | 11/1999 | Palmer | |
| 6,036,382 A | * | 3/2000 | Middleton | 400/225 |
| 6,307,583 B1 | | 10/2001 | Randolph et al. | |
| 6,641,314 B2 | * | 11/2003 | Mogi | 400/120.01 |
| 6,698,955 B2 | * | 3/2004 | Ozawa | 400/124.02 |
| 6,753,894 B2 | * | 6/2004 | Yoshida | 347/217 |

FOREIGN PATENT DOCUMENTS

EP 0861735 9/1998

* cited by examiner

*Primary Examiner*—Andrew H. Hirshfeld
*Assistant Examiner*—Dave A. Ghatt
(74) *Attorney, Agent, or Firm*—Lowe Hauptman Gilman & Berner, LLP

(57) ABSTRACT

A recording deice includes a cylinder (1) of heat-sensitive ink ribbon (2), a rewinding cylinder (5), and a marking header (19). The device prevents unused segments of ribbon being left between markings. The device has a moving support (6) guiding the ribbon (2) along an additional path (16), a braking mechanism (10, 11, 12, 14) for the cylinder (1). When the ribbon (2)is tractioned and the cylinder is braked, the support (6) is forced to move against the action of an elastic element (13), reducing the additional path (16). Thus, after a marking (a–b) the ribbon and the support (6) move back to (c) so that the next marking (b–d) is made immediately after the first marking (a–b). The braking mechanism, after one or more markings, are released, unrolling a length of ribbon (2) from the cylinder, then braking again, with the process repeated.

29 Claims, 2 Drawing Sheets

TRACTION DEVICE FOR HEAT-SENSITIVE INK RIBBON

This application is a continuation of Ser. No. 09/979,975, filed Apr. 9, 2002, now U.S. Pat. No. 6,629,791 which is a 371 PCT/ES01/00120 filed Mar. 27, 2001.

OBJECT OF THE INVENTION

The invention relates to a traction device for heat-sensitive ink ribbons as those used for marking surfaces, of the type which allow to fully employ the heat-sensitive ink ribbon, as currently devices are available in which unused ribbon segments are left between one marking and another. For this purpose the invention intends to use these segments by rewinding the ribbon using a simple and inexpensive device.

The invention is applicable to any type of marking with heat-sensitive ink ribbons, such as in marking plastic film with barcodes or other types of data.

BACKGROUND OF THE INVENTION

There exist in the present state of the art well-known devices for traction of heat-sensitive ink ribbon which comprise a cylinder of origin of the heat-sensitive ink ribbon which is guided by small rollers to a rewinding cylinder, which is related to a traction mechanism. In the path of the ribbon is provided at least one marking head, so that between markings as the ribbon advances there is a segment of ribbon left unused.

These type of devices have the disadvantage of wasting a large amount of heat-sensitive ink ribbon.

To solve this drawback a system is known which allows to rewind the ribbon so that marking is allowed using the ribbon segments which run between markings, for which means are provided which allow the rewinding cylinder to rotate in the sense opposite the advance sense. These means include two shafts, each related to a motor, which drive the ribbon when the rewinding cylinder is turned in said opposite sense, thereby allowing the ribbon to move backwards. This system requires to install additional motors and a precise electronic control, so that it is a sophisticated system with a high cost.

DESCRIPTION OF THE INVENTION

To achieve the aforementioned objectives the invention has developed a novel traction device for heat-sensitive ink ribbon which allows to use the entire ribbon, by means of a simple and inexpensive device.

With this purpose the device of the invention includes novel means for rewinding and tensioning the ribbon, characterised in that they include a moving support provided with guiding means for the ribbon, so that the ribbon executes an additional motion. In addition means are provided which brake the cylinder of origin so that when the ribbon is driven in the forward direction with the origin cylinder braked, the ribbon makes the support advance against the action of an elastic element which complements said support, thereby reducing the additional path traveled by the ribbon, so that after marking the driving means force a backwards motion of the ribbon. This backwards motion implies that the support moves back under the action of the elastic element, to place the marking head in a segment prior to the end of the marking already performed, equivalent to the space traveled by the ribbon during the time taken by the header to descend when making another mark. Thus, when this new mark is made the header will meet the ribbon just after the last marking performed, so that the entire ribbon is used in the marking.

In this manner the forwards-backwards motion of the ribbon does not affect in any way the cylinder of origin, which remains braked, thus greatly simplifying the forwards-backwards motion of the ribbon.

The braking means for the origin cylinder are driven by the moving support, so that after performing one or several markings with the corresponding advances and returns the support will release the braking means, to unroll a length of ribbon as requested by the traction means in a forward direction.

The braking means of the cylinder of origin acts when the moving support reaches a set advance position in which in contacts said braking means and these release the cylinder of origin. Thus while maintaining the advance of the traction means, the ribbon is unrolled by successive brakings-releases of the origin cylinder. Afterwards the traction rotation is inverted making the support return due to the action of the spring, so that the origin cylinder is again locked.

The entire process is repeated successively, and all while maintaining the ribbon tense by means of the elastic element which aids the moving support.

In order to attain this functionality the braking means of the origin cylinder are determined by a swivelling lever aided by a spring provided with a shoe, so that the spring keeps the shoe presses against the shaft of the origin cylinder.

The lever is placed in the path of the support, so that when the support contacts with it the lever swivels against the action of the spring, causing-the release of the origin cylinder. This situation allows unwinding of the origin cylinder when the ribbon is tractioned.

The elastic element which complements the support is a spring. Said support is retained in guides in which it slides during its forward and backward motion.

Additionally, a stop is provided which limits the run of the support during its backwards motion, in order to ensure the correct operation of the device.

The guide means for the ribbon provided in the support consist of a cylinder which aids the advance and return of the ribbon.

These and further characteristics of the invention will be made apparent in view of the accompanying drawings, where for purposes of illustration only the following is shown.

DESCRIPTION OF A PREFERRED EMBODIMENT

Figure 1:
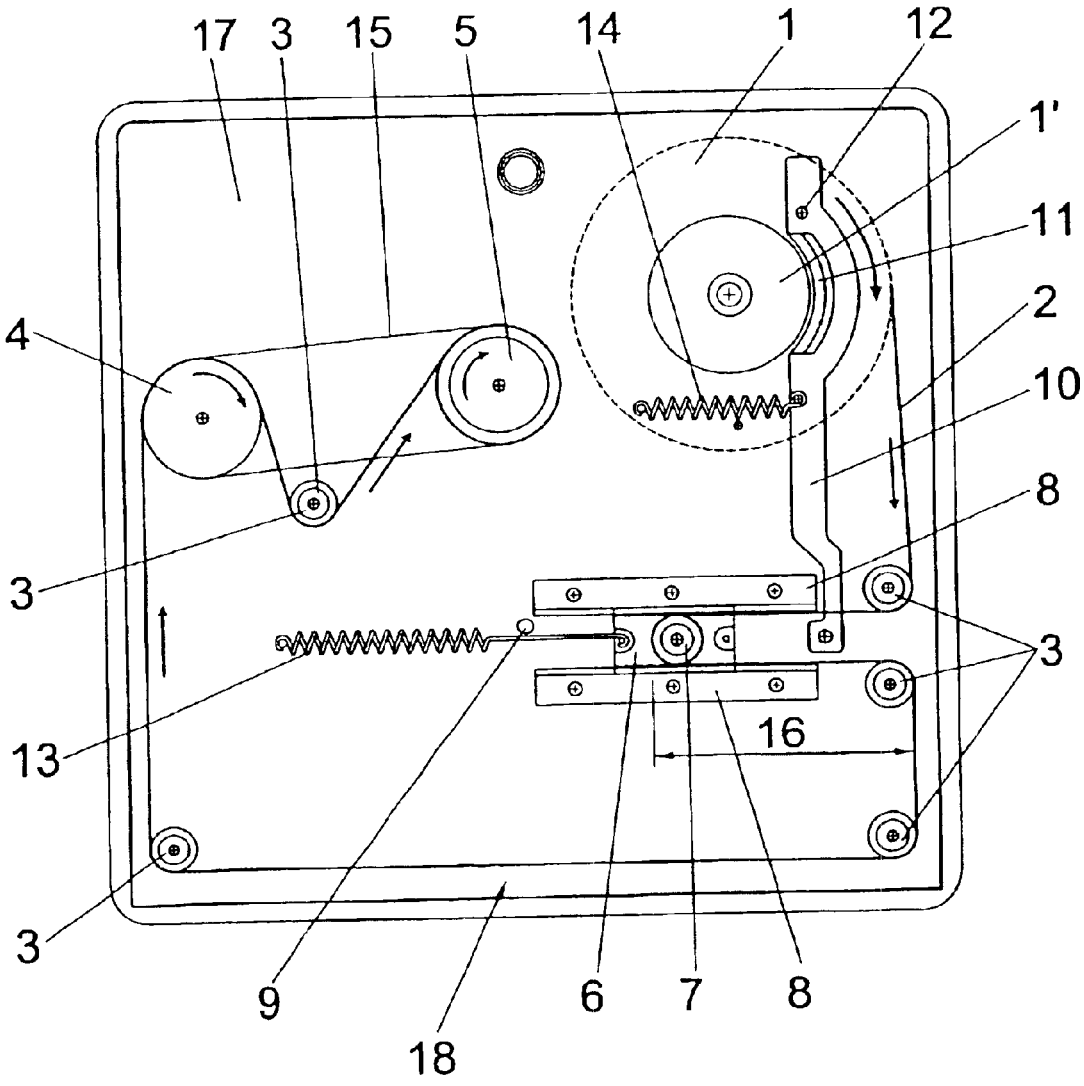
FIG. 1 shows an elevation view of an embodiment for the traction device for heat sensitive ink ribbon of the invention, in which the origin cylinder is represented in a discontinuous line to reveal the entire braking mechanism of the shaft of said cylinder.

A description of the invention follows with reference to the figures described above.

The traction device of the invention comprises a removable frame (17) mounted on a machine with heat sensitive marking devices which require heat-sensitive ribbon for said marking process.

In removable frame (17) is included an origin cylinder (1) which carries the heat-sensitive ink ribbon (2), which is guided by rollers (3) to a traction cylinder (4) which is related by a transmission belt (15) to a rewinding cylinder (5).

When the removable frame (17) is mounted on the marking machine its heads are next to the lower horizontal segment (18) of the heat-sensitive ink ribbon (2) (not shown in the figure as they are an the object of the invention).

Additionally the removable frame (17) has a moving support (6) retained by guides (8) and which includes a roller (7) on which is guided the heat-sensitive ink ribbon (2), so that the latter follows an additional path (16).

The moving support (6) is complemented by a spring (13) which pulls on it so that the tension of the heat-sensitive ink ribbon (2) is always maintained.

At the rear end of the run of the moving support (6) is provided a stop (9) which limits its run.

Additionally, a lever (10) is provided which is retained by a shaft (12) and which includes a shoe (11). Lever (10) is complemented by a spring (14), so that said spring keeps the shoe (11) pressed against the shaft (1') of the origin cylinder (1), and such that an end of lever (10) is placed at the end of the advance path of the moving support (6).

Figure 2:
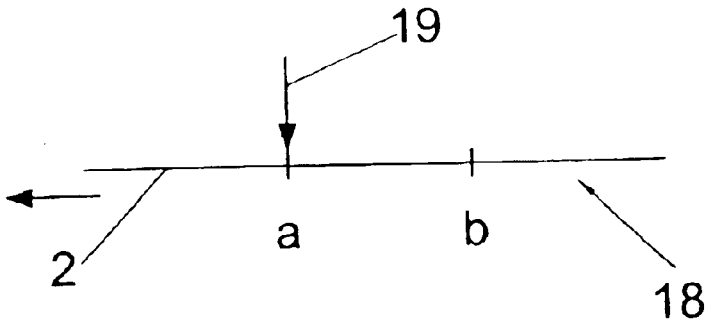
FIGS. 2 to 5 show a schematic representation of the marking process using the device of the invention.

Thus, to begin with the ribbon is mounted so that the el moving support (6) is in contact with stop (9) so that the origin cylinder (1) is braked. Marking is performed by placing head (19) on point (a) (FIG. 2) while the cylinder (4) causes the advance of the heat-sensitive ink ribbon (2), which pulls on the moving support (6), which overcomes the resistance of the spring (13) and moves along the guides (8), reducing the additional path (16).

Figure 3:
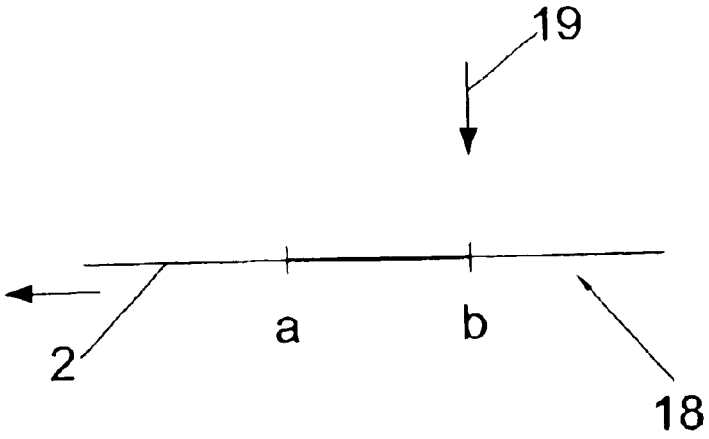
Figure 4:
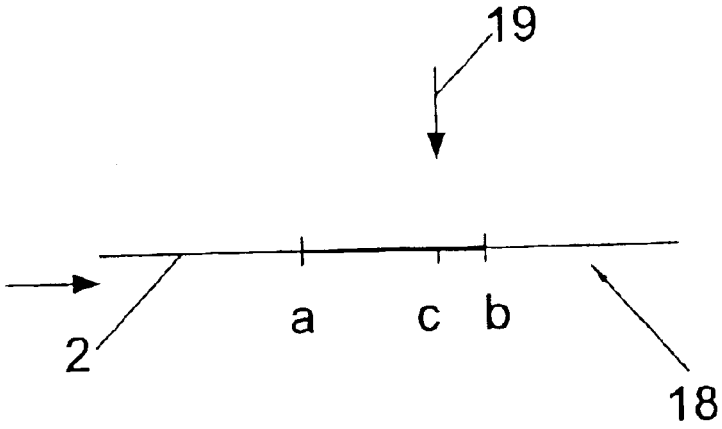
Figure 5:
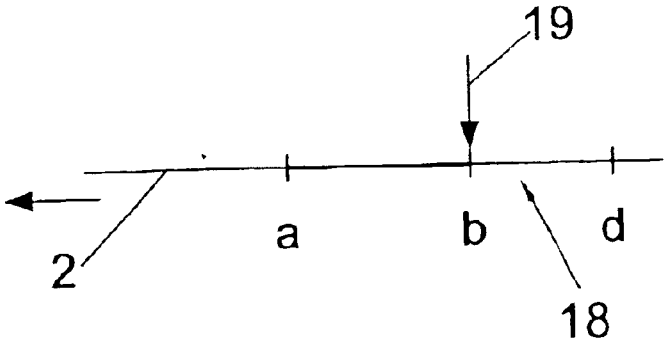

During the advance of the ribbon the marking takes place (a–b) (FIG. 3). Afterwards the rotation of the cylinder (4) is inverted, while maintaining the origin cylinder (1) braked so that as the support (13) is pulling on the support (6) the ribbon is forced to return until the header is placed at point (c). The distance (c–b) corresponds to the distance advanced by the ribbon in the time required for the header to descend and contact the said ribbon (2).

Therefore, after the header is located on point (c) a new marking takes place, with the advance of the ribbon and the descent of the header (19), which contacts the ribbon at point (b), exactly where the previous marking ended, at which point begins the marking (b–d).

This process is repeated to perform successive markings, so that there are no unused segments of ribbon between markings.

During the process described the moving support (6) runs from the position where it is in contact with stop (9) until it presses on lever (10), which lever is jointed to shaft (12), causing the release of shaft (1') of the origin cylinder (1). Thus the ribbon is unrolled in an amount required by the traction. Since the origin cylinder is braked again as soon as the moving support (6) stops pressing on the lever (10), to unroll the required length of ribbon the traction must act in the advance direction, with consecutive brakings-releases of the origin cylinder until the required ribbon is unrolled. Said brakings-releases occur so quickly that they can hardly be appreciated by the eye. After the required length of ribbon is unrolled the traction rotation direction is inverted so that the moving support (6) travels back towards the stop (9) as far as determined by the action of the spring (13), all such that the ribbon tension is maintained. In addition, during this return motion of the support (6) it stops acting on the lever (10), so that by action of the spring (14) the shoe (11) again contacts the shaft (1') of the origin cylinder (1), again causing the braking of said cylinder (1). The several brakings are attained quite efficiently as the inertia of the cylinder (1) during its unrolling is small.

It should be remarked that for high marking speeds the cylinder inertia is a significant parameter, as if it acquires a high inertia braking is hindered and thus the precision of the device is reduced.

The above described process is repeated sequentially until exhausting the heat-sensitive ink ribbon (2) wound on cylinder (1).

Therefore, the device of the invention allows to fully use the ribbon by means of a simple, precise and inexpensive mechanism.

What is claimed is:

1. A ribbon marking device for recording markings consecutively on a ribbon, said device comprising:

a unwind spindle;

a rewind spindle;

a plurality of ribbon guides about which said ribbon is to be entrained, said ribbon guides being arranged between said unwind spindle and said rewind spindle to define a path along which said ribbon operatively moves from said unwind spindle to said rewind spindle;

a moving support translationally moveable between a forward position and a rearward position, said moving support supporting thereon at least one of said ribbon guides; and an elastic element attached to said moving support and biasing said moving support toward the rearward position; and a marking head moveable toward and away from said path.

2. The device of claim 1, wherein a length of said path is longer when said moving support is in the rearward position than when said moving support is in the forward position.

3. The device of claim 1, further comprising a motor coupled to drive said rewind spindle in two opposite directions to advance and return said ribbon, respectively.

4. The device of claim 1, further comprising a frame supporting said spindles, ribbon guides and guides for said moving support, wherein said elastic element is a spring having one end attached to the moving support and another end attached to said frame.

5. A ribbon marking device for recording markings consecutively on a ribbon, said device comprising:

a unwind spindle;

a rewind spindle;

a plurality of ribbon guides about which said ribbon is to be entrained, said ribbon guides being arranged between said unwind spindle and said rewind spindle to define a path alone which said ribbon operatively moves from said unwind spindle to said rewind spindle;

a moving support moveable between a forward position and a rearward position, said moving support supporting thereon at least one of said ribbon guides;

an elastic element attached to said moving support and biasing said moving support toward the rearward position;

a marking head moveable toward and away from said path; and a braking element for braking a supply spool of said ribbon being supported on said unwind spindle when said moving support is in a position other than the forward position, wherein said braking element is released by said moving support to allow supply of said ribbon when said moving support reaches the forward position.

6. The device of claim 5, wherein when said moving support is in a position other than the forward position, said braking element brakes the supply spool of said ribbon being supported on said unwind spindle with a braking force sufficient to hold said supply spool irrotational; and when said moving support reaches the forward position, said braking element is released by said moving support to allow rotation of said supply spool, and hence, supply of said ribbon.

7. The device of claim 5, wherein said braking element comprises an actuation member located adjacent the forward position of said moving support and adapted to be actuated, by said moving support, only upon arrival of said moving support at the forward position to release said braking element.

8. The device of claim 5, wherein said braking element comprises a lever rotatable about a first portion thereof and having a second portion, which is located adjacent the forward position and adapted to be moved by said moving support when said moving support reaches the forward position.

9. The device of claim 8, wherein said lever includes a curved surface adapted to be pressed against the supply spool to prevent the supply spool from rotating.

10. The device of claim 8, further comprising a biasing element biasing said lever towards said unwind spindle, said second portion being moved by said moving support, when said moving support reaches the forward position, against a biasing force of said biasing element.

11. The device of claim 5, wherein when said moving support is in a position other than the forward position, said braking element brakes the supply spool of said ribbon being supported on said unwind spindle with a braking force greater than a biasing force of the elastic element.

12. A ribbon marking system, comprising:

a supply spool of ribbon;

a take-up spool of said ribbon;

a plurality of ribbon guides about which said ribbon is entrained, said ribbon guides being arranged between said spools to define a path along which said ribbon operatively moves from said supply spool to said take-up spool;

a moving support translationally moveable between a forward position and a rearward position, said moving support supporting thereon at least one of said ribbon guides; and an elastic element attached to said moving support and biasing said moving support toward the rearward position; and a marking head moveable toward and away from said ribbon.

13. The system of claim 12, wherein a length of said ribbon on said path gradually decreases as said moving support moves from the rearward position to the forward position.

14. The system of claim 12, further comprising a braking element that brakes said supply spool when said moving support is in a position other than the forward position, wherein said braking element is released by said moving support to allow supply of said ribbon from said supply spool when said moving support reaches the forward position.

15. The system of claim 12, further comprising a motor coupled to drive said take-up spool in two opposite directions to advance and return said ribbon, respectively.

16. The system of claim 15, wherein said supply spool is passively driven by said ribbon.

17. The system of claim 12, further comprising a frame pivotally supporting said spools, wherein said ribbon guides and guides for said moving support are also supported by said frame, and said elastic element is a spring having one end attached to the moving support and another end attached to said frame.

18. The system of claim 12, wherein said ribbon guides are idler rollers.

19. The system of claim 12, wherein said moving support is driven by said ribbon toward the forward position when said ribbon is tractioned in an advance direction from the supply spool toward the take-up spool.

20. The system of claim 12, wherein said ribbon is heat sensitive ink ribbon.

21. The device of claim 12, further comprising at least one guide element extending between said forward and rearward positions, said moving support being slidably mounted on said at least one guide element.

22. A method of recording markings on a ribbon without unused segments of said ribbons being left between the markings, said method comprising the steps of:

a) lowering a marking head on said ribbon, which has been entrained about a plurality of ribbon guides to extend between a supply spool and a take-up spool, and recording a marking on said ribbon;

b) raising said marking head away from said ribbon to a raised position;

c) returning said ribbon in a direction from said take-up spool to said supply spool so that said marking head is located above the recorded marking;

d) advancing said ribbon in an opposite direction from said supply spool to said take-up spool and lowering said marking head on said ribbon at a location immediately after the recorded marking to record another marking immediately slier the recorded marking; and e) repeating steps b), c) and d) for a number of times without unreeling said ribbon from said supply spool.

23. The method of claim 22, wherein in step c) said ribbon is returned a distance equivalent to a distance said ribbon is advanced in step d) during the time taken by the marking header to descend from the raised position to said ribbon.

24. The method of claim 22, further comprising braking the supply spool during step e) until a predetermined length of said ribbon has been wound onto said take-up spool.

25. The method of claim 24, wherein one of said ribbon guides is moveable relative to the other ribbon guides between first and second positions, and the predetermined length of said ribbon is defined by the first position of said moveable ribbon guide;

step e) comprising gradually moving the moveable ribbon guide, by repeating steps c) and d), against a tensioning force from the first position to the second position.

26. The method of claim 25, further comprising releasing the supply spool from the brake when the moveable ribbon guide reaches the second position; and allowing the moveable ribbon guide to return from the second position to the first position under action of said tensioning force, thereby unreeling a subsequent predetermined length of said ribbon from said supply spool.

27. A ribbon marking system, comprising:

a supply spool having a core and a length of ribbon wound around said core;

a take-up spool of said ribbon;

a plurality of ribbon guides about which said ribbon is entrained, said ribbon guides being arranged between said spools to define a path along which said ribbon operatively moves from said supply spool to said take-up spool;

a moving support moveable between a forward position and a rearward position, said moving support supporting thereon at least one of said ribbon guides;

a biasing element biasing said moving support toward the rearward position;

a marking head moveable toward and away from said ribbon; and a braking element directly and physically contacting said core and preventing said supply spool from rotating when said moving support is in a position other than the forward position.

28. The system of claim 27, wherein said braking element is released by said moving support to allow rotation of said supply spool, and hence supply of said ribbon, when said moving support reaches the forward position.

29. The system of claim 27, wherein a closest distance between said moving support and said braking element decreases as said moving support moves from the rearward position towards the forward position.

* * * * *